United States Patent [19]

Thomas

[11] Patent Number: 4,459,836

[45] Date of Patent: Jul. 17, 1984

[54] HYDRAULIC FORMING PROCESS AND APPARATUS

[76] Inventor: William K. Thomas, P.O. Box 472, Deer Lake Rd., Tomahawk, Wis. 54487

[21] Appl. No.: 341,382

[22] Filed: Jan. 21, 1982

[51] Int. Cl.[3] ..... B21D 22/10

[52] U.S. Cl. ..... 72/61; 72/347; 72/354

[58] Field of Search ..... 72/347, 348, 349, 54, 72/57, 58, 60, 354, 61

[56] References Cited

U.S. PATENT DOCUMENTS

| | | | |
|---|---|---|---|
| 1,561,312 | 11/1925 | Cutler . | |
| 3,000,274 | 9/1961 | Duskey . | |
| 3,149,596 | 9/1964 | DeVlieg et al. . | |
| 3,285,045 | 11/1966 | Berg | 72/54 |
| 3,695,201 | 10/1972 | Frankenberg | 72/348 |
| 3,934,440 | 1/1976 | Berg | 72/54 |
| 4,363,232 | 12/1982 | Reitter | 72/347 |

FOREIGN PATENT DOCUMENTS

| | | | |
|---|---|---|---|
| 39-15295 | 7/1964 | Japan | 72/60 |

*Primary Examiner*—Leon Gilden

*Attorney, Agent, or Firm*—Wheeler Law Firm

[57] ABSTRACT

Apparatus and method for forming a peripheral skirt on a workpiece of metal or other ductile material with reduced pleating of its peripheral edge. The concentric mating male and female dies of the prior art are provided, and in addition at least one drawbar concentric with, outside of, and generally beside the male die guides the outer periphery of the workpiece as the dies are urged together, preventing the outer margin of the workpiece from being folded under and propagating pleats. The drawbars also assist in clamping the outer margin of the workpiece between the dies when the central portion of the workpiece is to be expanded by the application of fluid forming pressure.

9 Claims, 4 Drawing Figures

HYDRAULIC FORMING PROCESS AND APPARATUS

TECHNICAL FIELD

The present invention relates to a process and apparatus for forming a peripheral skirt in sheet metal or other ductile materials. In one embodiment the invention also relates to means and apparatus for clamping the edge of a workpiece during a fluid forming process.

BACKGROUND ART

Pleating is a well known difficulty which arises when a peripheral skirt is formed in a previously flat workpiece. This problem occurs because when the outer margin of the workpiece is turned down to form a skirt its radius is reduced but its area is not. In prior apparatus and processes this problem is particularly acute because the outer edge of the workpiece is not controlled as bending begins; it thus tends to sweep downward suddenly, allowing pleats to radiate inwardly from the outer margin. (See FIG. 1.) The problem of pleating is mentioned in U.S. Pat. No. 3,000,274, issued to Duskey et al. on September 19, 1961; and U.S. Pat. No. 3,695,201, issued to Frankenberg on October 3, 1972.

Referring now to the art of fluid forming, in which the outer margin of a workpiece is clamped and a fluid pressure differential is introduced across the central part of the workpiece to form it, means must be provided for conveniently clamping the outer margin of the workpiece. Clamping can be difficult if, as in many applications, the external margin of the workpiece is to be drawn inwardly during the forming operation. Several patents which disclose the apparatus, processes, and problems of fluid forming are as follows: U.S. Pat. No. 3,934,440, issued to Berg on January 27, 1976; U.S. Pat. No. 3,285,045, issued to Berg on November 15, 1966; U.S. Pat. No. 3,149,596, issued to De Vlieg et al. on September 22, 1964; U.S. Pat. No. 1,561,312, issued to Cutler et al. on November 10, 1925; and Japanese patent document No. 15295/64, assigned to Nippon Oils and Fat Company, Ltd. Previous apparatus for forming a skirted workpiece has not been optimally suited to clamp the workpiece for a subsequent fluid forming step.

SUMMARY OF THE INVENTION

A first object of the present invention is to reduce or eliminate pleating of a workpiece as a skirt is formed about it. A second object of the present invention is to provide means for forming a skirt in a workpiece which also clamps the workpiece for a subsequent fluid forming operation. Other objects of the invention will become apparent from the description which follows.

One aspect of the present invention is a die set comprising a male die, a mating annular female die, closing means to bring the dies together with sufficient force to form a skirt on a workpiece positioned between the dies, and as the novel element an annular drawbar disposed outside the margins of the male and female dies and extending axially toward the female die. When the dies come together to form a peripheral skirt in the workpiece, the drawbar supports the outer margin of the workpiece, preventing it from turning sharply downward and thereby propagating pleats. As the workpiece is drawn over the male die, the outer margin of the workpiece is permitted to be drawn radially inward, facilitating the formation of a skirt. Two or more drawbars may be arranged concentrically, in which case the drawbars decrease in axial length from the outermost drawbar to the innermost one. The apparatus may also include means for introducing a pressurized fluid adjacent the workpiece after the skirt is formed.

Another aspect of the present invention is a process for forming a skirt, comprising the steps of providing the foregoing male and female dies; providing the foregoing drawbar; placing a workpiece between the dies in overlapping relation to the drawbar; and advancing the dies together to capture the sheet between them and form a skirt. Using this method the workpiece is rolled radially outward and axially about the male die, which reduces or eliminates pleating but allows the outer margin of the workpiece to be drawn inward to supply additional material as the skirt is formed. If a fluid forming step is desired, it is performed when the male and female dies are together. The skirt forming method described herein forms a depression in the workpiece in which the female die element is received, which improves the ability of the dies to clamp the workpiece during fluid forming. More than one drawbar can be used in practicing the process.

DETAILED DESCRIPTION OF THE PREFERRED EMBODIMENT

Although the disclosure hereof is detailed and exact to enable those skilled in the art to practice the invention, the physical embodiments herein disclosed merely exemplify the invention, which may be embodied in other specific structure. While the best known embodiment has been described, the details may be changed without departing from the invention, which is defined by the claims.

Figure 2:
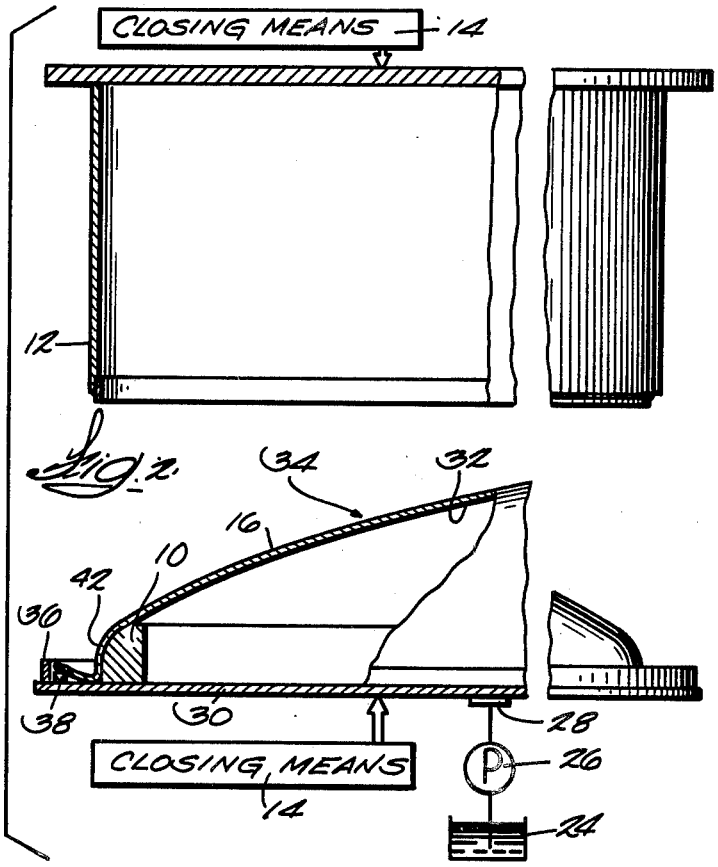
FIG. 2 is a similar view of the apparatus of the present invention when the dies are separated, showing a formed workpiece in place on the male die and drawbars.
Figure 4:
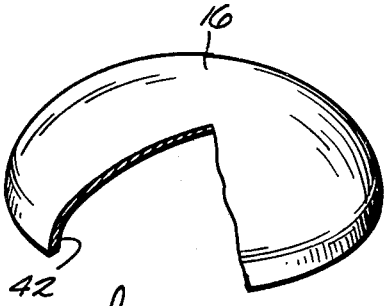
FIG. 4 is a perspective view of a finished workpiece made according to the present invention, partly in cross-section to show detail.
Figure 3:
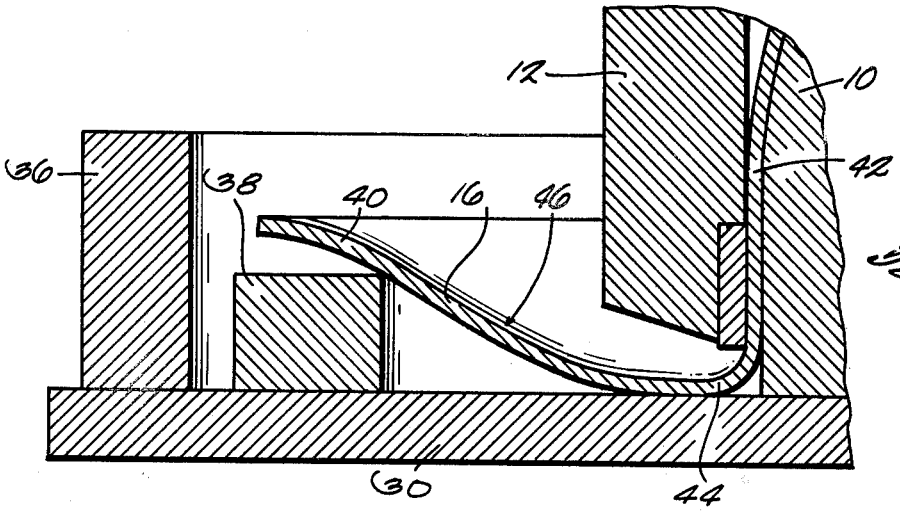
FIG. 3 is an enlarged fragmentary view similar to FIG. 2, but showing the dies closed together.

FIGS. 2 and 3 show the elements of the apparatus invention and illustrate the practice of the process invention.

Figure 1:
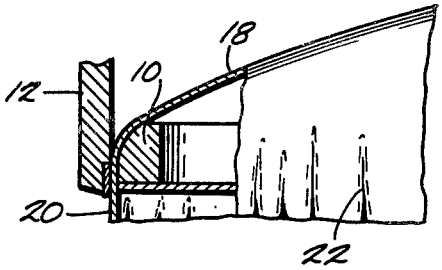
Fig. 1 PRIOR ART
FIG. 1 is a fragmentary side elevation, partly in section, of a prior art skirt forming apparatus and the defective workpiece which results from its use.

The known elements of the apparatus are an annular male die 10, a mating annular female die 12, and closing means schematically shown at 14 for urging dies 10 and 12 together to form a workpiece 16. Those elements are also present in the prior art and are shown in FIG. 1, with the exceptions that the workpiece is denoted as 18 and the closing means 14 are not shown in FIG. 1. When workpiece 18 is formed by the known apparatus shown in FIG. 1 its outer margin 20 develops numerous pleats 22 which create an objectionable appearance and are not easily removed to form a satisfactory stamping.

Referring again to FIG. 2, the fluid reservoir 24, pump 26, and conduit 28 passing through backing plate 30 are conventional, and are used for forming workpiece 16 by creating a greater pressure in the enclosed space between backing plate 30 and surface 32 of workpiece 16 than is present at surface 34 of the same workpiece.

The novel aspect of the present invention is the presence of at least one drawbar, here two drawbars (36, 38) for supporting and controlling the outer margin 40 of workpiece 16 as a peripheral skirt 42 is formed in the workpiece. Drawbar 36 has a longer axial extent than drawbar 38; when more than one drawbar is present each drawbar has a greater axial extent than the drawbar of the next smaller radius and a smaller axial extent than the drawbar of the next greater radius. The workpiece is supported at a first position at first, and when sufficiently drawn in it is supported at a second position further from female die 12 and nearer backing plate 30 or another suitable support for the drawbars.

The drawbars function as follows. Absent the drawbars, the outer margin 40 of the workpiece would be turned downward suddenly as male die 10 entered female die 12; as a result, pleats would rapidly propagate, and some pleats would usually extend into the skirt. As the male die extended progressively further into the female die these pleats would be folded over and flattened, but would not necessarily be ironed out. The resulting workpiece would have the puckered margin shown in FIG. 1, which is unacceptable. But with drawbars in place, the outer margin 40 of workpiece 16 is prevented from folding under or puckering, and as shown in FIG. 3 it is not folded under even as the dies are at their nearest approach. As a result, the material of workpiece 16 is rolled radially outward about male die 10. Outer margin 40 is not confined by a clamp, as in some prior art apparatus, so it is drawn inward to supply additional material as workpiece 16 is drawn about male die 10.

Although not essential to the invention, it is convenient to support the drawbars and male die on a single backing plate to maintain their relative orientation.

Another feature of the present invention is that it increases the strength of the grip of workpiece 16 between the male and female dies when fluid forming pressure is to be applied to the central portion of the workpiece. FIG. 1 illustrates that in the prior art workpiece 16 would tend to be drawn upward between the dies due to fluid pressure applied to the workpiece from below. FIG. 3 illustrates that when the present invention is practiced the workpiece develops an outer flange 44 defining a depression 46 in which female die 12 is received to provide additional clamping.

I claim:

1. In a die set for forming a skirt on a workpiece without pleating it, comprising a male die, a mating annular female die, and closing means to bring said dies together with sufficient force to form a skirt on a workpiece positioned between said dies;

the improvement comprising a first annular drawbar extending axially toward said female die and spaced radially outside the work piece engaging surface of said dies;

whereby to support the portion of said workpiece lying outside the outer margin of said female die as said closing means is operated to form said skirt, thus causing said workpiece to be rolled radially outward about said male die.

2. The die set of claim 1, further comprising a second annular drawbar fixed concentrically with and spaced radially within said first drawbar;

whereby to first support the portion of said workpiece which is outside the margin of said female die on said first drawbar at a first position, then to support said portion on said second drawbar at a second position as said portion is drawn inwardly.

3. The die set according to claim 1 or 2, wherein said male die and each said drawbar are supported on a backing plate.

4. The die set of claim 2, wherein said first drawbar extends further axially toward said female die than said second drawbar.

5. The die set according to claim 1 or 2, further comprising means for introducing a pressurized fluid adjacent one face of a workpiece held by said die set for axially expanding at least a central portion of said workpiece.

6. The die set according to claim 1, wherein each said drawbar is a circular annulus.

7. A method for forming a skirt on a workpiece without pleating the same, comprising the steps of:

A. providing registered male and female dies;

B. providing an annular drawbar disposed outside the margin of said female die;

C. placing a workpiece between said dies in overlapping relation to said draw-bar; and D. advancing said dies together to capture said sheet; supporting the outer margin of said workpiece on said drawbar as said dies are closed together, thereby progressively rolling said workpiece radially outward about said male die.

8. The method of claim 7, comprising the further step of introducing a fluid under pressure adjacent one face of said workpiece for axially expanding at least a central portion of said workpiece.

9. The method of claim 7, further comprising, between said steps B and C, the step of providing a second annular drawbar fixed with respect to said male die and disposed within the margin of said first drawbar and outside the margin of said female die, whereby to first support the portion of said workpiece outside the margin of said female die at a first position, then in succession to support said portion at a second position axially further from said female die as said dies are closed together.

* * * * *